United States Patent [19]

Nelson

[11] 4,410,456

[45] Oct. 18, 1983

[54] ADDITIVES FOR ENHANCING CORONA STABILIZATION IN ELECTRONEGATIVE GASES

[75] Inventor: John K. Nelson, Schenectady, N.Y.

[73] Assignee: General Electric Company, Schenectady, N.Y.

[21] Appl. No.: 365,722

[22] Filed: Apr. 5, 1982

[51] Int. Cl.[3] ..... H01B 3/16

[52] U.S. Cl. ..... 252/571; 174/17 GF; 174/25 G

[58] Field of Search ..... 252/571; 174/17 GF, 174/25 G

[56] References Cited

U.S. PATENT DOCUMENTS

| | | | |
|---|---|---|---|
| 1,886,153 | 11/1932 | Perrotti | 252/571 |
| 3,209,063 | 9/1965 | Eiseman, Jr. | 252/571 |
| 3,249,681 | 5/1966 | Eiseman, Jr. | 252/571 |
| 3,281,521 | 10/1966 | Wilson | 252/571 |

OTHER PUBLICATIONS

"A Model for the Breakdown for $SF_6$ in the Presence of Positive Impulse Corona", Third International Symposium on High Voltage Engineering, Aug. 28–31, 1979, Milan, Italy.

"Corona Stabilization and the Critical Pressure in $SF_6$ and $SF_6/N_2$ Mixtures", O. Farish, R. C. Davidson and D. J. Tedford, 1977.

"Prebreakdown Corona Processes in $SF_6$ and $SF_6/N_2$ Mixtures", O. Farish, O. E. Ibrahim, A. Kurimoto, Third International Symposium on High Voltage Engineering, Aug. 28–31, 1979, Milan, Italy.

"Static Field Anode Corona Characteristics in Sulfur Hexafluoride", R. Hazel, E. Kuffel, IEEE Transactions on Power Apparatus and Systems, vol. PAS-95, No. 1, Jan./Feb., 1976.

"Absolute Oscillator Strengths (5–6 eV) for Photoabsorption and Ionic Fragmentation of $SF_6$", A. P. Hitchcock, M. J. VanderWiel, Journal of Physics B: Atomic and Molecular Physics, vol. 12, No. 13, 1979.

*Primary Examiner*—John E. Kittle

*Assistant Examiner*—Robert A. Wax

*Attorney, Agent, or Firm*—Lawrence D. Cutter; James C. Davis, Jr.; Marvin Snyder

[57] ABSTRACT

Corona stabilization in electronegative gases such as $SF_6$ is enhanced through the use of additives exhibiting ionization potentials which lie in the range in which the photon absorption characteristic of the electronegative insulating gas, as a function of ionization energy, exhibits minimal values. Accordingly, the present invention not only discloses such methods for enhancing corona stabilization but also discloses gaseous mixtures exhibiting this enhanced corona stabilization characteristic. Enhanced corona stabilization is important in that it produces significantly increased divergent field breakdown voltages in the gaseous mixture in gas pressure ranges which are of significant interest to the electrical industry. In particular, it is seen herein that tri-ethylamine is a particularly effective additive for use with $SF_6$.

10 Claims, 6 Drawing Figures

50% SF6 + 50% N2
II
I
TIP RADIUS = 1 mm
BREAKDOWN
INCEPTION
VOLTAGE (KILOVOLTS)
PRESSURE (ATMOSPHERES, ABSOLUTE)
0
10
20
30
40
50
60
70
80
90
0
1
2
3
4
5
6

ADDITIVES FOR ENHANCING CORONA STABILIZATION IN ELECTRONEGATIVE GASES

BACKGROUND OF THE DISCLOSURE

The present invention relates to additives for enhancing corona stabilization in electronegative gases and, more particularly, relates to methods and gases for improving electrical breakdown voltage characteristics in such insulating gases for divergent field situations.

In the electric utility industry, there have been concerted efforts to increase energy efficiencies in the generation and transmission of electrical energy. Many of the schemes for increasing energy efficiencies have also been associated with need for operation at higher voltage levels. Accordingly, much effort has been expended over the previous decade, and before, to develop gases exhibiting excellent insulating properties, particularly for use in newer, more efficient electrical energy production and transmission systems. A particularly useful insulating gas has been found to be sulfur hexafluoride, $SF_6$. However, it has also been found that typical electronegative insulating gases such as $SF_6$ exhibit their optimal divergent field breakdown voltages at pressures which are higher than atmospheric. In particular, it has been generally observed that pressures of from about 1 to 6 atmospheres are desirable for $SF_6$ itself. It has also generally been observed, with respect to $SF_6$, that at operating pressure ranges above approximately 3 atmospheres divergent field corona stabilization ceases to provide enhanced insulating properties. In particular, it has been observed that in such pressure ranges, there is a vanishingly small voltage difference between inception of corona discharge and ultimate breakdown of the insulating gas in nonuniform fields.

In an insulating gas, electron collisions with neutral gas molecules typically result in one of two possible conditions. Either the colliding electron will ionize the molecule, producing separate charged entities or the electron will attach itself to the molecule, in which case ionization does not result. The rate at which electron collisions result in ionization is referred to as the ionization coefficient $\alpha$. The rate at which electrons attach themselves to the gas molecules is referred to as the attachment coefficient, $\eta$. Accordingly, the net ionization coefficient, $\bar{\alpha}$, is defined as $\alpha-\eta$. For electronegative gases, $\eta>0$. It is these electronegative gases which are generally of concern herein.

In high voltage electrical systems, the greatest problems arise in those areas in which the electric field is nonuniform. Such nonuniform, divergent electric fields most typically are produced in those situations in which there is a sharp-edged feature in the high voltage system under consideration. Such divergent field-causing features may often include such mundane surfaces as the sharp edges on hex head bolts or particulate contamination in systems which are designed to exhibit quasi-uniform fields. It is in these regions in which the greatest electric field strengths are produced and, accordingly, such sharp edges and points are often the initiating points for gas breakdown. In fact, it is comon amongst experimenters in spark breakdown phenomena to simulate such sharp edges through the use of a point electrode spaced a certain distance from a flat planar electrode. Such experimental conditions were employed in investigations involving the methods and mixtures of the present invention. Furthermore, it has also been well documented in the art that the greatest problems associated with electrical breakdown occur in those instances in which the pointed electrode is connected to the positive side of a voltage source.

However, it is well documented that in such divergent field situations as are found in the point/plane gap configuration with the point being positive, that the corona discharge occurring has a stabilizing influence on the breakdown characteristic. Nonetheless, it should be noted that it is also known that this phenomena is highly dependent upon the pressure of the gas employed. For example, for gases such as $SF_6$, it is known that in the absolute pressure range between about 1 atmosphere and 3 atmospheres, the presence of corona discharge produces a stabilizing influence on the breakdown characteristics of the gas. However, this advantage has in the past not been extendable to higher insulating gas pressure ranges which are of particular importance in the electrical utility industry. The physics contributing to the corona enhancement of breakdown voltage is very complex, but, in general, the onset of corona forms a conducting cloud in the region of the point or sharp edge, which has the effect of modifying the field to increase the breakdown voltage. The collaborative streamers forming a part of this conducting cloud exist only within an ionization zone for which the net ionization coefficient, $\bar{\alpha}$, is greater than 0. These collaborative streamers are initiated by secondary electrons produced by photoionization. Accordingly, the number of electrons produced by photoionization is dependent upon photoabsorption in the gas. However, the characterisitic photoabsorption curve for insulating gases has generally been ignored as a means for improving corona stabilization characteristics and the associated increases in breakdown voltage in the insulating gas, particularly in gas pressure ranges of industrial interest.

SUMMARY OF THE INVENTION

In accordance with a preferred embodiment of the present invention, a method for enhancing corona stabilization in electronegative, electrically insulating gases comprises adding an additive gas to the insulating gas, the additive possessing an ionization potential which lies in a range in which the photo absorption characteristic of the insulating gas, as a function of ionization energy, exhibits minimal values. In particular, in one embodiment of the present invention, triethylamine is added to $SF_6$, or a mixture of $SF_6$ and nitrogen in an amount effective to increase the breakdown voltage in an insulating gas employed at a pressure in excess of about 2 atmospheres.

In accordance with another preferred embodiment of the present invention, an enhanced insulating gas comprises an insulating gas exhibiting a range of ionization energies in which the photon absorption characteristic of the gas, as a function of ionization energy, exhibits minimal values together with an additive gas in mixture with the insulating gas, the additive gas exhibiting an ionization potential lying within the range of minimal photon absorption values of the insulating gas. In the particular embodiment in which $SF_6$ is employed, triethylamine may be added to the extent necessary to produce a partial pressure of up to 5 Torr per atmosphere.

Accordingly, it is an object of the present invention to provide a method for enhancing corona stabilization in electronegative gases.

It is a further object of the present invention to provide a gas mixture exhibiting enhanced corona stabilization.

It is an additional object of the present invention to increase the breakdown voltage in electronegative, electrically insulating gases for divergent field conditions.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
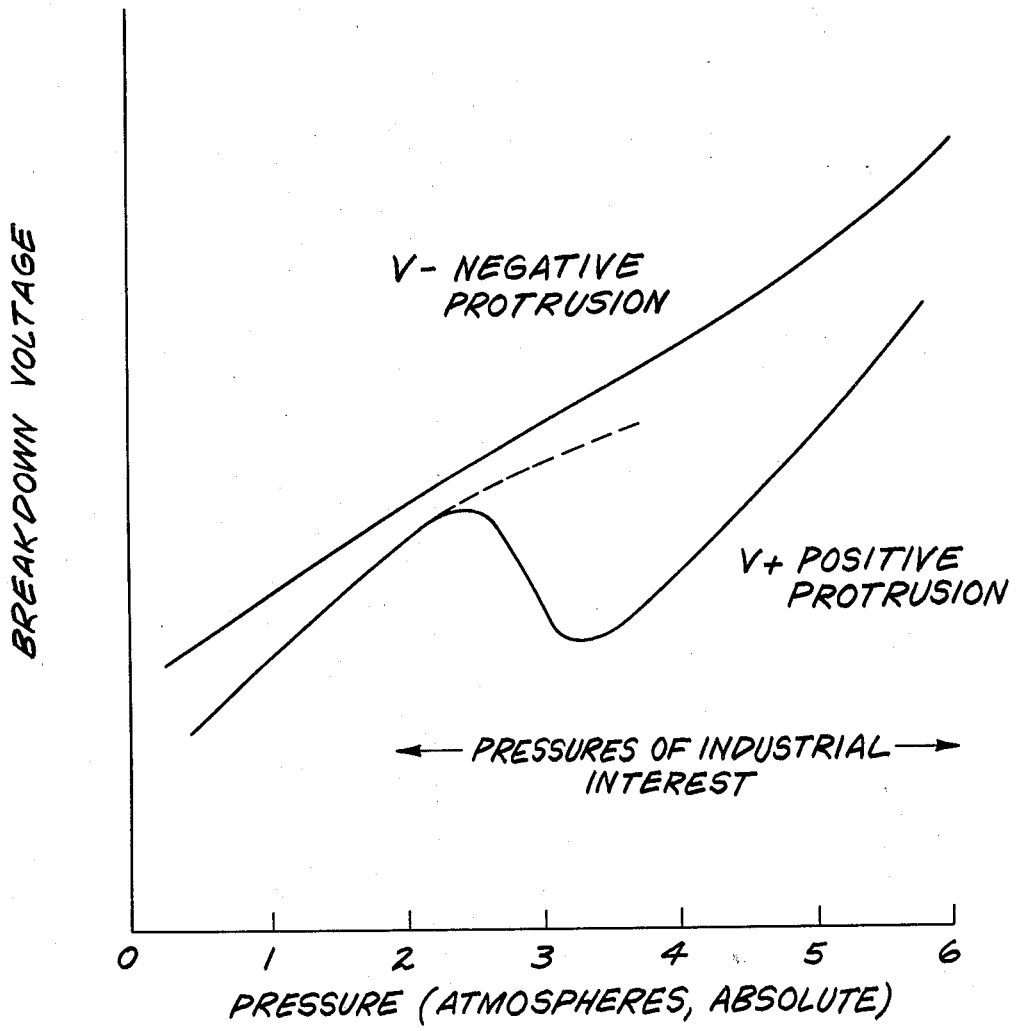
FIG. 1 is a characteristic plot of breakdown voltage versus pressure for negative protrusions and positive protrusions.

FIG. 1 illustrates the characteristic breakdown behavior of electronegative gases in divergent electric fields. Such fields are particularly evident in high voltage electrical systems haviing sharp-edged portions or other features which may create field intensification. Such situations are generally simulated in the laboratory using pointed electrodes and a flat plate conductor. As is evident in the graph, negatively polarized edges or protrusions generally exhibit a higher breakdown voltage value as a function of insulating gas pressure. However, it is also seen that positively charged protrusions exhibit a significant decrease in breakdown voltage in a pressure range of from about 2 to about 7 atmospheres. It is also seen that this range of reduced breakdown voltage capacity occurs within a significant portion of the pressures of industrial interest. The dotted curve extending from the knee portion of the positive protrusion curve generally indicates the improvement in performance which are accomplished by the method and mixtures of the present invention.

Figure 2:
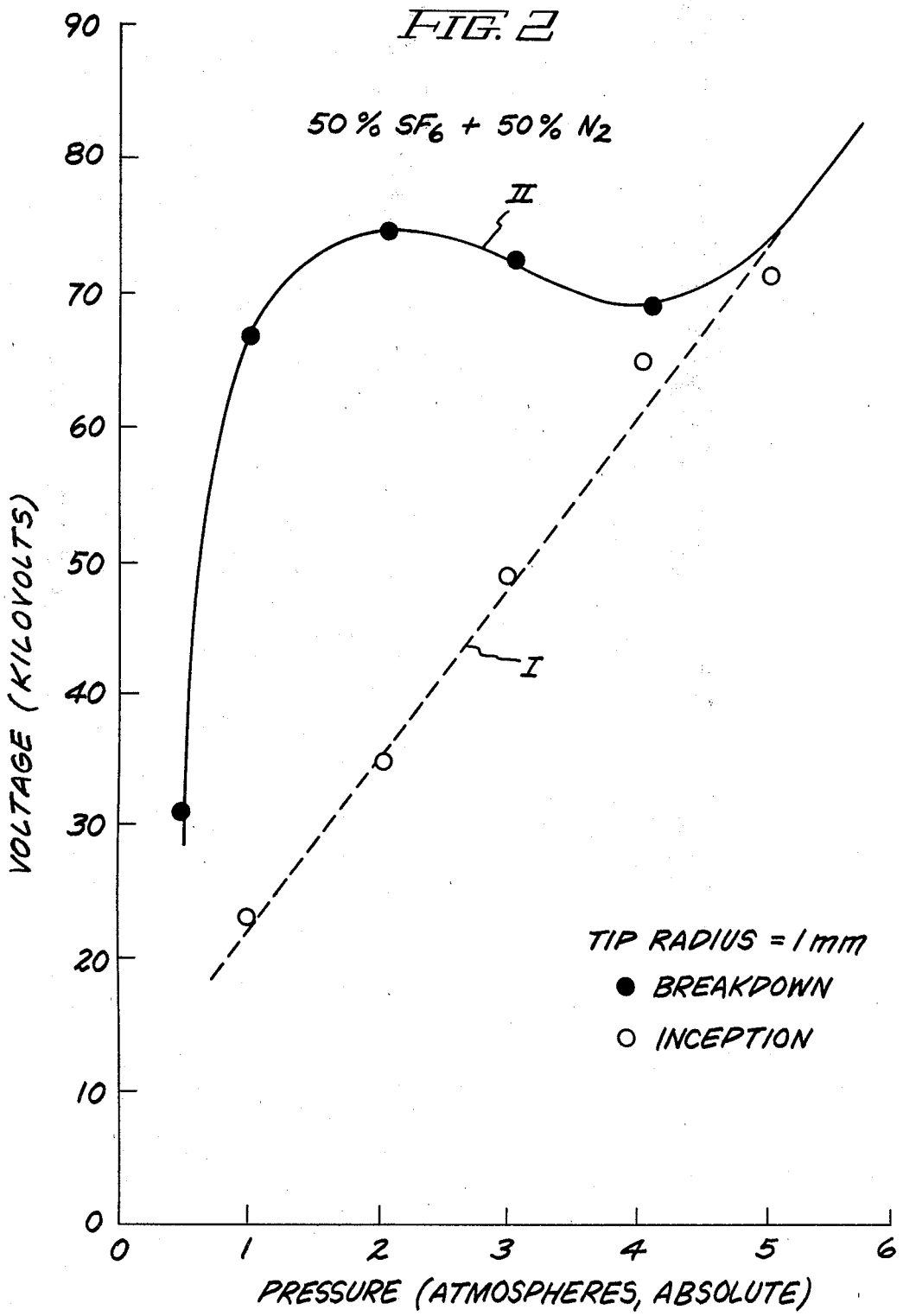
FIG. 2 is a plot of voltage versus pressure illustrating the difference between corona inception and breakdown voltage for various pressures in a mixture of $SF_6$ and nitrogen.

FIG. 2 illustrates the behavior of a mixture of 50% $SF_6$ and 50% nitrogen. The behaviors illustrated here are the breakdown voltage as a function of insulating gas pressure illustrated by curve II together with a second, generally linear curve, I, indicating the inception of corona discharge as a function of gas pressure. Here, as in FIG. 1, there is shown the undesirable drop in breakdown voltage occurring between a pressure of between about 2 and 7 atmospheres. It is this undesirable drop, in this pressure range, which the present invention significantly alleviates. Nonetheless, at the lower insulating gas pressures shown in FIG. 2, it should be appreciated that the inception of corona discharge actually increases the breakdown of voltage. As mentioned above, the mechanism for breakdown voltage increase is complex, but it is generally believed to be based upon ionization in the corona region surrounding the electrode tip, the ionization effectively acting to reduce nonuniformities in the divergent electric field. In short, the presence of the corona appears to smooth out steep variations in the electric field, thus making it more closely resemble a uniform field.

Figure 3:
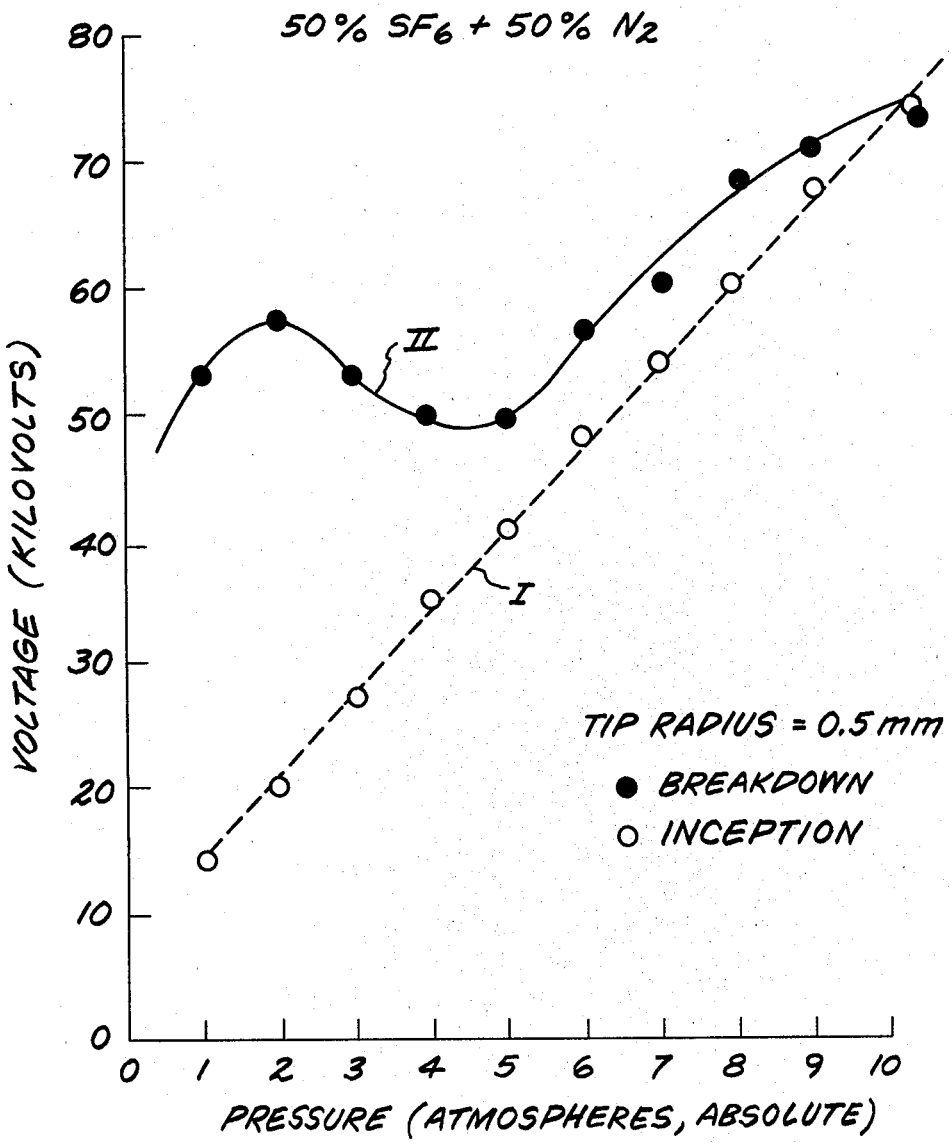
FIG. 3 is a plot similar to FIG. 2 illustrating the effect of tip radius on the curves.

FIG. 3 is similar to FIG. 2 except that a tip radius of 0.5 millimeter was employed in obtaining the experimental results indicated. As in FIG. 2, the insulating gas employed was a mixture of 50% $SF_6$ and 50% nitrogen. Again, lower curve I is a plot of corona discharge inception voltage as a function of gas pressure. Several things are apparent from the curves shown. In particular, it is seen that the smaller tip radius also exhibits a markedly improved effect upon the breakdown voltage particularly in the region between 1 and 3 atmospheres of insulating gas pressure. It is also apparent from the curves shown that at gas pressures in excess of about 3 or 4 atmospheres, there is little or no voltage difference between the inception of corona discharge and breakdown of the insulating gas. In contrast, at the lower insulating gas pressures, there is a significant enhancement of breakdown voltage as a result of the presence of corona discharge. However, as indicated above, it is nonetheless desirable to employ the insulating gases at the higher pressures since increasing the pressure generally increases the breakdown voltage, the exception being in the knee region of curve II of FIG. 2 between a pressure of about 2 and about 4 atmospheres. It is an object of the present invention to improve the breakdown voltage of the insulating gas in the range of operating pressure generally exceeding about 2 atmospheres.

Figure 4:
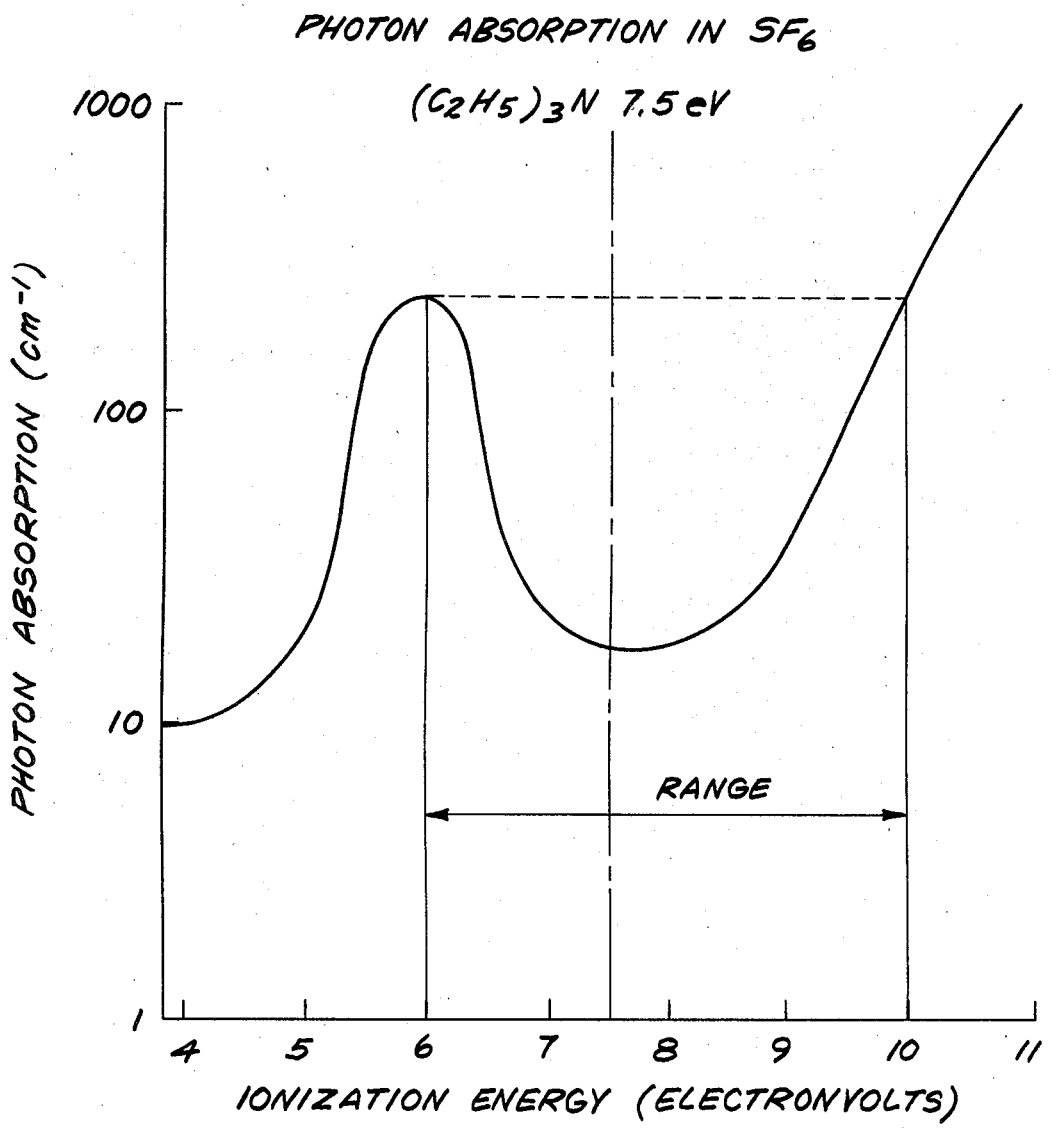
FIG. 4 is a plot of the photoabsorption characteristic of $SF_6$ as a function of ionization energy in the low energy region.

FIG. 4 illustrates a plot of the photon absorption characteristic for $SF_6$ gas as a function of ionization energy in the low energy region. It is to be particularly noted in this graph that there is a window or valley in the photon absorption value for $SF_6$ lying betwen ionization energies of approximately 6 to approximately 10 electron volts. In the present invention, the insulating gas, such as $SF_6$, is doped with a small amount of a substance having a low ionization energy which falls within this window or valley range. It is presently thought that the addition of such a corona stabilization enhancement additive operates by contributing to ionization effects in the outermost regions of the resulting corona discharge. It is further thought that the additive or additives thereby operate to increase the size of the corona discharge region and to thereby assist in the creation of a more uniform electric field. In this way, regions of space surrounding the electrode tip are not subject to the same high electric field strength levels and, accordingly, the breakdown voltage level is increased. Thus, any electronegative insulating gas exhibiting a photoabsorption characteristic curve having valleys or ranges of minimal values can be made to exhibit improved corona stabilization characteristics by the addition of small amounts of additive substances having ionization energy levels falling within this range of minimal values. In the instant application, the term "minimal", as used here and in the appended claims, generally refers to a valley or a dip in the curve rather than to a single point of absolute minimum as might be suggested in a strictly mathematical sense.

In one embodiment of the instant invention, it has been found that small amounts of tri-ethylamine, an additive exhibiting an ionization potential energy of 7.5 electron volts, may be employed as a suitable additive in $SF_6$ or in mixtures of $SF_6$ and nitrogen or in gases exhibiting similar photoionization curves. The principal requirement for the additive is that it exhibits an ionization potential energy falling within the range of minimal photon absorption values exhibited by the insulating gas itself. The amount of additive gas chosen is selected to be sufficient to increase the breakdown voltage of the resultant mixture in the desired pressure range. Such amounts are readily determinable for each situation of interest by means of tests conducted with the point/-plane electrode configuration discussed above. For the electronegative insulating gas $SF_6$, sufficient additive gas, namely tri-ethylamine $(C_2H_5)_3N$ is added to produce, in one instance, a partial vapor pressure of tri-ethylamine of 1 Torr and, in another instance, a partial vapor pressure of 9 Torr. Experimental results conducted on such mixtures have been made and the results are summarized in FIG. 5.

Figure 5:
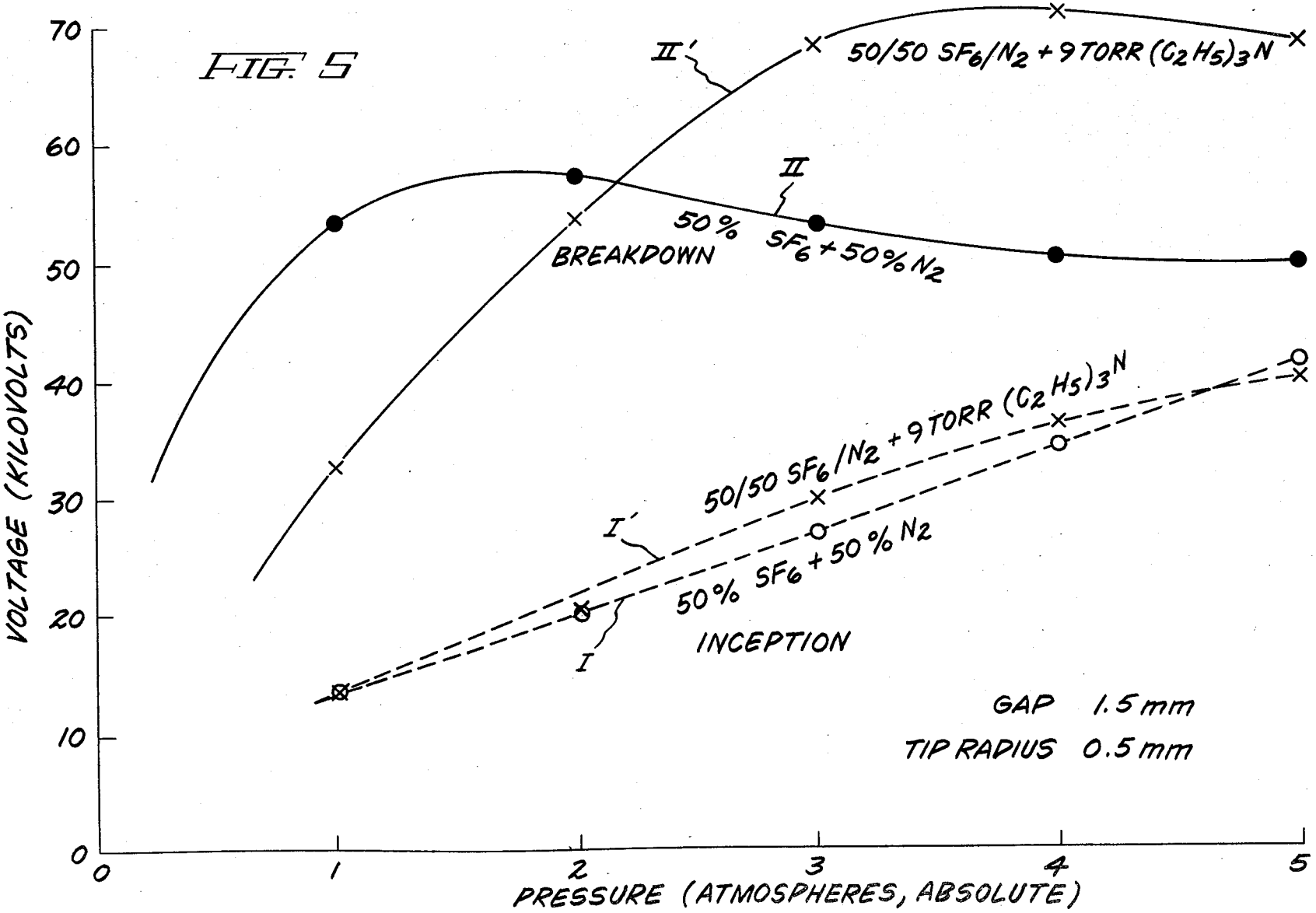
FIG. 5 is a plot of corona inception and breakdown curves for $SF_6$ mixtures with and without a tri-ethylamine additive.

In FIG. 5, four curves are shown. Curve I is a plot of corona discharge inception voltage as a function of gas pressure in a mixture of 50% $SF_6$ and 50% nitrogen. Curve I' is a curve similar to I except that corona discharge initiation is plotted for a gas comprising equal amounts of $SF_6$ and nitrogen, together with a sufficient amount of tri-ethylamine to produce a partial vapor pressure of 9 Torr. In FIG. 5 it is accordingly seen that curve I' represents a slight improvement in applied voltage values over curve I in describing inception of corona discharge. Curve II is the same as curve II in FIG. 3 and is a plot of breakdown voltage as a function of pressure of a mixture of equal quantities of $SF_6$ and nitrogen. However, in contrast, curve II' is indicative of the enhancement in breakdown voltage obtainable through the use of the present invention. In particular, in constructing curve II', the gas employed was a mixture of equal amounts of $SF_6$ and nitrogen, together with sufficient quantities of tri-ethylamine to produce a partial vapor pressure (of tri-ethylamine) of 9 Torr. For curve II', the most significant area of interest is the range of pressures above approximately 2 atmospheres. In this region it is seen that the use of the additive tri-ethylamine significantly increases the breakdown voltage in the gas. Even though the additive actually reduces the breakdown voltage in the pressure range below approximately 2 atmospheres, this is not significant since the pressure range of interest generally lies above 2 atmospheres. Thus, it is seen that, for all practical purposes, the additive of the present invention significantly increases the breakdown voltage of the insulating gas employed.

Figure 6:
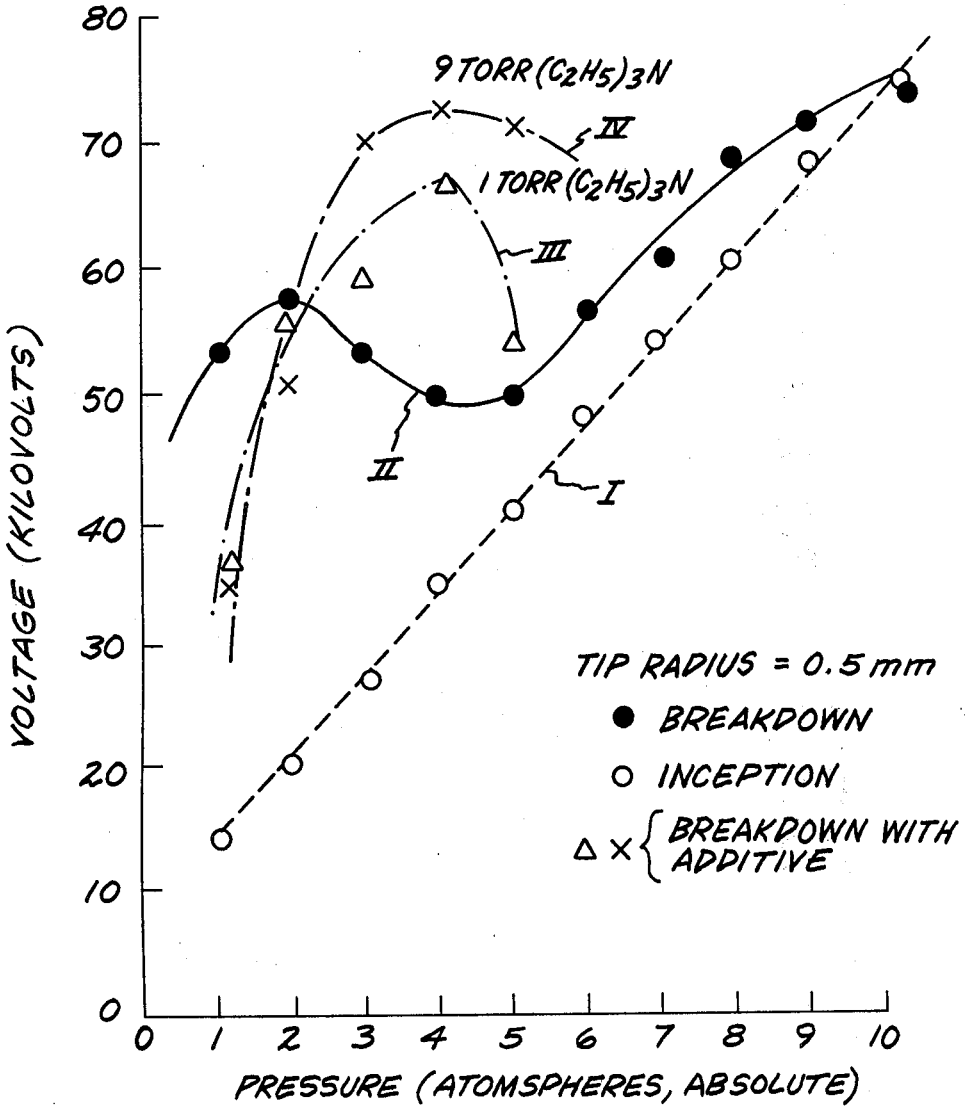
FIG. 6 is similar to FIG. 5 further illustrating the effect of different amounts of tri-ethylamine additive.

FIG. 6 is another graph illustrating the improved performance in breakdown voltage in a mixture of $SF_6$ and nitrogen. In this graph, curves I and II are the same as is shown in FIG. 3. Additionally shown herein are curves III and IV corresponding to breakdown voltage curves as a function of pressure with various amounts of tri-ethylamine present in a mixture of equal quantities of $SF_6$ and nitrogen. Curve III illustrates the improved performance characteristic for an amount of tri-ethylamine additive sufficient to produce a partial vapor pressure of 1 Torr. Curve IV is the corresponding curve for a partial vapor pressure of tri-ethylamine of 9 Torr. In each case it is seen that a significant increase in the breakdown voltage occurs in he range between about 2 and about 6 atmospheres, which is the range of most significant commercial interest.

In the present invention, the most significant requirement is that there exist a valley or range of minimal values in the photoabsorption characteristic of the selected insulating electronegative gas employed. For such a gas or gas mixture, an additive gas is chosen so that the additive gas possesses an ionization potential energy lying within this range of minimal values. Such a range, for example, is shown in FIG. 4.

While the experiments conducted with respect to the present invention have particularly employed a mixture of equal amounts of $SF_6$ and nitrogen, the nitrogen was included as an additional constituent primarily for experimental purposes to enhance corona detection schemes. However, because of the relatively high cost of $SF_6$, mixtures of $SF_6$ and nitrogen may be employed in electrical insulating systems in which cost is a particularly important factor. Even though $SF_6$ is diluted with 50% nitrogen, there is not a corresponding 50% decrease in breakdown strength of the insulating gas mixture. The reduction in strength is, in fact, much less, generally only about 25%. Thus a mixture of $SF_6$ and nitrogen, or other suitable gases, are employable in the present invention, along with gaseous mixtures including only $SF_6$ and the desired additive. Furthermore, tri-ethylamine is not the only additive that may be employed in the present invention. Other possible additives include tri-methyl amine. In particular, with reference to the use of additives for $SF_6$, the principal requirement of the additive gas is that it exhibit an ionization potential energy of between about 6 electron volts and 10 electron volts.

From the above it may be appreciated that the present invention provides an extremely facile and economical method for enhancing corona stabilization in electronegative gases and correspondingly increases the electrical breakdown strength of the gas in those operating pressure regions which are of primary interest to the commercial electrical industry. The present invention not only provides a method for such enhancement, but also includes gaseous mixtures exhibiting such improved characteristic performance in electrical breakdown strength.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A method for enhancing corona stabilization in electronegative, electrically insulating gases or gas mixtures comprising:

adding an additive gas to said insulating gas, said additive possessing an ionization potential which lies in a range in which the photon absorption characteristic of said insulating gas, as a function of ionization energy, exhibits minimal values.

2. The method of claim 1 in which said insulating gas is $SF_6$ and said additive exhibits an ionization potential energy between about 6 electron volts and about 10 electron volts.

3. The method of claim 2 in which said additive comprises tri-ethylamine.

4. The method of claim 3 in which said tri-ethylamine is added in an amount sufficient to produce a partial vapor pressure of up to 5 Torr per atmosphere.

5. The method of claim 1 in which said gas is a mixture of $SF_6$ and nitrogen.

6. A gas, especially for use in insulating high voltage electrical systems, comprising:

an insulating gas exhibiting a range of ionization energies in which the photon absorption characteristic of said gas, as a function of ionization energy, exhibits minimal values; and an additive gas in mixture with said insulating gas, said additive gas exhibiting an ionization potential lying within said range of minimal photon absorption values.

7. The gas of claim 6 in which said insulating gas is $SF_6$ and said additive gas exhibits an ionization potential energy between about 6 electron volts and about 10 electron volts.

8. The gas of claim 7 in which said additive comprises tri-ethylamine.

9. The gas of claim 8 in which said tri-ethylamine is added in an amount sufficient to produce a partial pressure of up to 5 Torr per atmosphere.

10. The gas of claim 7 in which said insulating gas is a mixture of $SF_6$ and nitrogen.

* * * * *